US007468722B2

(12) United States Patent
Ferguson

(10) Patent No.: US 7,468,722 B2
(45) Date of Patent: Dec. 23, 2008

(54) METHOD AND APPARATUS TO CONTROL DISPLAY BRIGHTNESS WITH AMBIENT LIGHT CORRECTION

(75) Inventor: Bruce R. Ferguson, Anaheim, CA (US)

(73) Assignee: Microsemi Corporation, Irvine, CA (US)

( * ) Notice: Subject to any disclaimer, the term of this patent is extended or adjusted under 35 U.S.C. 154(b) by 522 days.

(21) Appl. No.: 11/023,295

(22) Filed: Dec. 27, 2004

(65) Prior Publication Data

US 2005/0190142 A1 Sep. 1, 2005

Related U.S. Application Data

(60) Provisional application No. 60/543,094, filed on Feb. 9, 2004.

(51) Int. Cl.
*G09G 3/36* (2006.01)

(52) U.S. Cl. ..... 345/102; 345/87; 345/103; 345/104

(58) Field of Classification Search ..... 345/102–104, 345/87
See application file for complete search history.

(56) References Cited

U.S. PATENT DOCUMENTS

| | | | |
|---|---|---|---|
| 2,429,162 | A | 10/1947 | Russell et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Eilichi et al. |
| 3,141,112 | A | 7/1964 | Eppert |
| 3,449,629 | A | 6/1969 | Wigert et al. |
| 3,565,806 | A | 2/1971 | Ross |
| 3,597,656 | A | 8/1971 | Douglas |
| 3,611,021 | A | 10/1971 | Wallace |
| 3,683,923 | A | 8/1972 | Anderson |
| 3,737,755 | A | 6/1973 | Calkin et al. |
| 3,742,330 | A | 6/1973 | Hodges et al. |
| 3,916,283 | A | 10/1975 | Burrows |
| 3,936,696 | A | 2/1976 | Gray |
| 3,944,888 | A | 3/1976 | Clark |
| 4,053,813 | A | 10/1977 | Komrumpf et al. |
| 4,060,751 | A | 11/1977 | Anderson |
| 4,204,141 | A | 5/1980 | Nuver |
| 4,277,728 | A | 7/1981 | Stevens |

(Continued)

FOREIGN PATENT DOCUMENTS

| | | |
|---|---|---|
| EP | 0326114 | 8/1989 |

(Continued)

OTHER PUBLICATIONS

Nguyen, Don J., "Optimizing Mobile Power Delivery", Presented at Intel Developers Forum, Fall 2001, p. 4.

(Continued)

*Primary Examiner*—Kevin M. Nguyen
(74) *Attorney, Agent, or Firm*—Knobbe, Martens, Olson & Bear LLP

(57) ABSTRACT

An ambient light sensor produces a current signal that varies linearly with the level of ambient light. The current signal is multiplied by a user dimming preference to generate a brightness control signal that automatically compensates for ambient light variations in visual information display systems. The multiplying function provides noticeable user dimming control at relatively high ambient light levels.

21 Claims, 10 Drawing Sheets

U.S. PATENT DOCUMENTS

| | | | | |
|---|---|---|---|---|
| 4,307,441 | A | | 12/1981 | Bello |
| 4,353,009 | A | | 10/1982 | Knoll |
| 4,388,562 | A | | 6/1983 | Josephson |
| 4,392,087 | A | | 7/1983 | Zansky |
| 4,437,042 | A | | 3/1984 | Morais et al. |
| 4,441,054 | A | | 4/1984 | Bay |
| 4,463,287 | A | | 7/1984 | Pitel |
| 4,469,988 | A | | 9/1984 | Cronin |
| 4,480,201 | A | | 10/1984 | Jaeschke |
| 4,523,130 | A | | 6/1985 | Pitel |
| 4,543,522 | A | | 9/1985 | Moreau |
| 4,544,863 | A | | 10/1985 | Hashimoto |
| 4,555,673 | A | | 11/1985 | Huijsing et al. |
| 4,562,338 | A | | 12/1985 | Okami |
| 4,567,379 | A | | 1/1986 | Corey et al. |
| 4,572,992 | A | | 2/1986 | Masaki |
| 4,574,222 | A | | 3/1986 | Anderson |
| 4,585,974 | A | | 4/1986 | Stupp et al. |
| 4,622,496 | A | | 11/1986 | Dattilo et al. |
| 4,626,770 | A | | 12/1986 | Price, Jr. |
| 4,630,005 | A | | 12/1986 | Clegg et al. |
| 4,663,566 | A | | 5/1987 | Nagano |
| 4,663,570 | A | | 5/1987 | Luchaco et al. |
| 4,672,300 | A | | 6/1987 | Harper |
| 4,675,574 | A | | 6/1987 | Delflache |
| 4,682,080 | A | | 7/1987 | Ogawa et al. |
| 4,686,615 | A | | 8/1987 | Ferguson |
| 4,689,802 | A | | 8/1987 | McCambridge |
| 4,698,554 | A | | 10/1987 | Stupp et al. |
| 4,700,113 | A | | 10/1987 | Stupp et al. |
| 4,717,863 | A | | 1/1988 | Zeiler |
| 4,745,339 | A | | 5/1988 | Izawa et al. |
| 4,761,722 | A | | 8/1988 | Pruitt |
| 4,766,353 | A | | 8/1988 | Burgess |
| 4,779,037 | A | | 10/1988 | LoCascio |
| 4,780,696 | A | | 10/1988 | Jirka |
| 4,792,747 | A | | 12/1988 | Schroeder |
| 4,812,781 | A | | 3/1989 | Regnier |
| 4,847,745 | A | | 7/1989 | Shekhawat |
| 4,862,059 | A | | 8/1989 | Tominaga et al. |
| 4,885,486 | A | | 12/1989 | Shekhawat et al. |
| 4,893,069 | A | | 1/1990 | Harada et al. |
| 4,902,942 | A | | 2/1990 | El-Hamamsy et al. |
| 4,939,381 | A | | 7/1990 | Shibata |
| 4,998,046 | A | | 3/1991 | Lester |
| 5,023,519 | A | | 6/1991 | Jensen |
| 5,030,887 | A | | 7/1991 | Guisinger |
| 5,036,255 | A | | 7/1991 | McKnight et al. |
| 5,049,790 | A | | 9/1991 | Herfurth et al. |
| 5,057,808 | A | | 10/1991 | Dhyanchand |
| 5,083,065 | A | | 1/1992 | Sakata et al. |
| 5,089,748 | A | | 2/1992 | Ihms |
| 5,105,127 | A | | 4/1992 | Lavaud et al. |
| 5,130,565 | A | | 7/1992 | Girmay |
| 5,130,635 | A | | 7/1992 | Kase |
| 5,173,643 | A | | 12/1992 | Sullivan et al. |
| 5,220,272 | A | | 6/1993 | Nelson |
| 5,235,254 | A | | 8/1993 | Ho |
| 5,289,051 | A | | 2/1994 | Zitta |
| 5,317,401 | A | * | 5/1994 | Dupont et al. ..... 345/98 |
| 5,327,028 | A | | 7/1994 | Yum et al. |
| 5,349,272 | A | | 9/1994 | Rector |
| 5,406,305 | A | * | 4/1995 | Shimomura et al. ..... 345/102 |
| 5,410,221 | A | | 4/1995 | Mattas et al. |
| 5,420,779 | A | | 5/1995 | Payne |
| 5,430,641 | A | | 7/1995 | Kates |
| 5,434,477 | A | | 7/1995 | Crouse et al. |
| 5,440,208 | A | | 8/1995 | Uskali et al. |
| 5,463,287 | A | | 10/1995 | Kurihara et al. |
| 5,471,130 | A | | 11/1995 | Agiman |
| 5,475,284 | A | | 12/1995 | Lester et al. |
| 5,475,285 | A | | 12/1995 | Konopka |
| 5,479,337 | A | | 12/1995 | Voigt |
| 5,485,057 | A | | 1/1996 | Smallwood et al. |
| 5,485,059 | A | | 1/1996 | Yamashita et al. |
| 5,485,487 | A | | 1/1996 | Orbach et al. |
| 5,493,183 | A | | 2/1996 | Kimball |
| 5,495,405 | A | | 2/1996 | Fujimura et al. |
| 5,510,974 | A | | 4/1996 | Gu et al. |
| 5,514,947 | A | | 5/1996 | Berg |
| 5,519,289 | A | | 5/1996 | Katyl et al. |
| 5,528,192 | A | | 6/1996 | Agiman |
| 5,539,281 | A | | 7/1996 | Shackle et al. |
| 5,548,189 | A | | 8/1996 | Williams |
| 5,552,697 | A | | 9/1996 | Chan |
| 5,557,249 | A | | 9/1996 | Reynal |
| 5,563,473 | A | | 10/1996 | Mattas et al. |
| 5,563,501 | A | | 10/1996 | Chan |
| 5,574,335 | A | | 11/1996 | Sun |
| 5,574,356 | A | | 11/1996 | Parker |
| 5,608,312 | A | | 3/1997 | Wallace |
| 5,612,594 | A | | 3/1997 | Maheshwari |
| 5,612,595 | A | | 3/1997 | Maheshwari |
| 5,615,093 | A | | 3/1997 | Nalbant |
| 5,619,104 | A | | 4/1997 | Eunghwa |
| 5,619,402 | A | | 4/1997 | Liu |
| 5,621,281 | A | | 4/1997 | Kawabata et al. |
| 5,629,588 | A | | 5/1997 | Oda et al. |
| 5,635,799 | A | | 6/1997 | Hesterman |
| 5,652,479 | A | | 7/1997 | LoCascio et al. |
| 5,663,613 | A | | 9/1997 | Yamashita et al. |
| 5,705,877 | A | | 1/1998 | Shimada |
| 5,710,489 | A | | 1/1998 | Nilssen |
| 5,712,533 | A | | 1/1998 | Corti |
| 5,712,776 | A | | 1/1998 | Palara et al. |
| 5,719,474 | A | | 2/1998 | Vitello |
| 5,744,915 | A | | 4/1998 | Nilssen |
| 5,748,460 | A | | 5/1998 | Ishihawa |
| 5,751,115 | A | | 5/1998 | Jayaraman et al. |
| 5,751,120 | A | | 5/1998 | Zeitler et al. |
| 5,751,560 | A | | 5/1998 | Yokoyama |
| 5,754,012 | A | | 5/1998 | LoCascio |
| 5,754,013 | A | | 5/1998 | Praiswater |
| 5,760,760 | A | | 6/1998 | Helms |
| 5,770,925 | A | | 6/1998 | Konopka et al. |
| 5,777,439 | A | | 7/1998 | Hua |
| 5,786,801 | A | | 7/1998 | Ichise |
| 5,796,213 | A | | 8/1998 | Kawasaki |
| 5,808,422 | A | | 9/1998 | Venkitasubrahmanian et al. |
| 5,818,172 | A | | 10/1998 | Lee |
| 5,822,201 | A | | 10/1998 | Kijima |
| 5,825,133 | A | | 10/1998 | Conway |
| 5,828,156 | A | | 10/1998 | Roberts |
| 5,844,540 | A | | 12/1998 | Terasaki |
| 5,854,617 | A | | 12/1998 | Lee et al. |
| 5,859,489 | A | | 1/1999 | Shimada |
| 5,872,429 | A | | 2/1999 | Xia et al. |
| 5,880,946 | A | | 3/1999 | Biegel |
| 5,883,473 | A | | 3/1999 | Li et al. |
| 5,886,477 | A | | 3/1999 | Honbo et al. |
| 5,892,336 | A | | 4/1999 | Lin et al. |
| 5,901,176 | A | | 5/1999 | Lewison |
| 5,910,709 | A | | 6/1999 | Stevanovic et al. |
| 5,910,713 | A | | 6/1999 | Nishi et al. |
| 5,912,812 | A | | 6/1999 | Moriarty, Jr. et al. |
| 5,914,842 | A | | 6/1999 | Sievers |
| 5,923,129 | A | | 7/1999 | Henry |
| 5,923,546 | A | | 7/1999 | Shimada et al. |
| 5,925,988 | A | | 7/1999 | Grave et al. |
| 5,930,121 | A | | 7/1999 | Henry |
| 5,930,126 | A | | 7/1999 | Griffin et al. |
| 5,936,360 | A | | 8/1999 | Kaneko |
| 5,939,830 | A | | 8/1999 | Praiswater |
| 6,002,210 | A | | 12/1999 | Nilssen |

6,011,360 A 1/2000 Gradzki et al.
6,016,245 A 1/2000 Ross
6,020,688 A 2/2000 Moisin
6,028,400 A 2/2000 Pol et al.
6,037,720 A 3/2000 Wong et al.
6,038,149 A 3/2000 Hiraoka et al.
6,040,661 A 3/2000 Bogdan
6,040,662 A 3/2000 Asayama
6,043,609 A 3/2000 George et al.
6,049,177 A 4/2000 Felper
6,069,448 A 5/2000 Yeh
6,072,282 A 6/2000 Adamson
6,091,209 A 7/2000 Hilgers
6,104,146 A 8/2000 Chou et al.
6,108,215 A 8/2000 Kates et al.
6,111,370 A 8/2000 Parra
6,114,814 A 9/2000 Shannon et al.
6,121,733 A 9/2000 Nilssen
6,127,785 A 10/2000 Williams
6,127,786 A 10/2000 Moison
6,137,240 A 10/2000 Bogdan
6,150,772 A 11/2000 Crane
6,157,143 A 12/2000 Bigio et al.
6,160,362 A 12/2000 Shone et al.
6,169,375 B1 1/2001 Moisin
6,172,468 B1 1/2001 Hollander
6,181,066 B1 1/2001 Adamson
6,181,083 B1 1/2001 Moisin
6,181,084 B1 1/2001 Lau
6,188,183 B1 2/2001 Greenwood et al.
6,188,553 B1 2/2001 Moisin
6,194,841 B1 2/2001 Takahasi et al.
6,198,234 B1 3/2001 Henry
6,198,236 B1 3/2001 O'Neill
6,198,238 B1 3/2001 O'Neill
6,211,625 B1 4/2001 Nilssen
6,215,256 B1 4/2001 Ju
6,218,788 B1 4/2001 Chen et al.
6,229,271 B1 5/2001 Liu
6,239,558 B1 5/2001 Fujimura et al.
6,252,355 B1 6/2001 Meldrum et al.
6,255,784 B1 7/2001 Weindorf
6,259,215 B1 7/2001 Roman
6,259,615 B1 7/2001 Lin
6,281,636 B1 8/2001 Okutsu et al.
6,281,638 B1 8/2001 Moisin
6,291,946 B1 9/2001 Hinman
6,294,883 B1 9/2001 Weindorf
6,307,765 B1 10/2001 Choi
6,310,444 B1 10/2001 Chang
6,313,586 B1 11/2001 Yamamoto et al.
6,316,881 B1 11/2001 Shannon et al.
6,316,887 B1 11/2001 Ribarich et al.
6,317,347 B1 11/2001 Weng
6,320,329 B1 11/2001 Wacyk
6,323,602 B1 11/2001 De Groot et al.
6,331,755 B1 12/2001 Ribarich et al.
6,340,870 B1 1/2002 Yamashita et al.
6,344,699 B1 2/2002 Rimmer
6,351,080 B1 2/2002 Birk et al.
6,356,035 B1 3/2002 Weng
6,359,393 B1 3/2002 Brown
6,362,577 B1 3/2002 Ito et al.
6,388,388 B1 5/2002 Weindorf et al.
6,396,217 B1 5/2002 Weindorf
6,396,722 B2 5/2002 Lin
6,417,631 B1 7/2002 Chen et al.
6,420,839 B1 7/2002 Chiang et al.
6,424,100 B1 7/2002 Kominami et al.
6,429,839 B1 * 8/2002 Sakamoto ..... 345/87
6,433,492 B1 8/2002 Buonavita
6,441,943 B1 8/2002 Roberts et al.
6,445,141 B1 9/2002 Kastner et al.
6,452,344 B1 9/2002 MacAdam et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,479,810 B1 11/2002 Weindorf
6,483,245 B1 11/2002 Weindorf
6,486,618 B1 11/2002 Li
6,494,587 B1 12/2002 Shaw et al.
6,495,972 B1 12/2002 Okamoto et al.
6,501,234 B2 12/2002 Lin et al.
6,507,286 B2 1/2003 Weindorf et al.
6,509,696 B2 1/2003 Bruning et al.
6,515,427 B2 2/2003 Oura et al.
6,515,881 B2 2/2003 Chou et al.
6,521,879 B1 2/2003 Rand et al.
6,522,558 B2 2/2003 Henry
6,531,831 B2 3/2003 Chou et al.
6,534,934 B1 3/2003 Lin et al.
6,559,606 B1 5/2003 Chou et al.
6,563,479 B2 5/2003 Weindorf et al.
6,570,344 B2 5/2003 Lin
6,570,347 B2 5/2003 Kastner
6,583,587 B2 6/2003 Ito et al.
6,593,703 B2 7/2003 Sun
6,628,093 B2 9/2003 Stevens
6,630,797 B2 10/2003 Qian et al.
6,633,138 B2 10/2003 Shannon et al.
6,642,674 B2 11/2003 Liao et al.
6,650,514 B2 11/2003 Schmitt
6,654,268 B2 11/2003 Choi
6,664,744 B2 12/2003 Dietz
6,703,998 B1 3/2004 Kabel et al.
6,707,264 B2 3/2004 Lin et al.
6,710,555 B1 3/2004 Terada et al.
6,864,867 B2 3/2004 Biebl
6,717,371 B2 4/2004 Lin et al.
6,717,372 B2 4/2004 Lin et al.
6,717,375 B2 4/2004 Noguchi et al.
6,724,602 B2 4/2004 Giannopoulos
6,765,354 B2 7/2004 Klein
6,781,325 B2 8/2004 Lee
6,784,627 B2 8/2004 Suzuki et al.
6,803,901 B1 10/2004 Numao
6,804,129 B2 10/2004 Lin
6,809,718 B2 * 10/2004 Wei et al. ..... 345/102
6,816,142 B2 11/2004 Oda et al.
6,856,099 B2 2/2005 Chen et al.
6,856,519 B2 2/2005 Lin et al.
6,870,330 B2 3/2005 Choi
6,876,157 B2 4/2005 Henry
6,897,698 B1 5/2005 Gheorghiu et al.
6,900,599 B2 5/2005 Ribarich
6,900,600 B2 5/2005 Rust et al.
6,900,993 B2 5/2005 Lin et al.
6,922,023 B2 7/2005 Hsu et al.
6,930,893 B2 8/2005 Vinciarelli
6,936,975 B2 8/2005 Lin et al.
6,947,024 B2 9/2005 Lee et al.
6,967,449 B2 11/2005 Ishihara
6,967,657 B2 * 11/2005 Lowles et al. ..... 345/102
6,969,958 B2 11/2005 Henry
6,979,959 B2 12/2005 Henry
7,026,860 B1 4/2006 Gheorghiu et al.
7,057,611 B2 6/2006 Lin et al.
7,075,245 B2 7/2006 Liu
7,095,392 B2 8/2006 Lin
7,120,035 B2 10/2006 Lin et al.
7,151,394 B2 12/2006 Gheorghiu et al.
7,183,724 B2 2/2007 Ball
7,190,123 B2 3/2007 Lee
7,202,458 B2 * 4/2007 Park ..... 345/102

| | | | | |
|---|---|---|---|---|
| 7,233,117 | B2 | 6/2007 | Wang et al. | |
| 7,236,020 | B1 | 6/2007 | Virgil | |
| 2001/0036096 | A1 | 11/2001 | Lin | |
| 2002/0030451 | A1 | 3/2002 | Moisin | |
| 2002/0097004 | A1 | 7/2002 | Chiang et al. | |
| 2002/0114114 | A1 | 8/2002 | Schmitt | |
| 2002/0118182 | A1 | 8/2002 | Weindorf | |
| 2002/0130786 | A1 | 9/2002 | Weindorf | |
| 2002/0135319 | A1 | 9/2002 | Bruning et al. | |
| 2002/0140538 | A1 | 10/2002 | Yer | |
| 2002/0145886 | A1 | 10/2002 | Stevens | |
| 2002/0153852 | A1 | 10/2002 | Liao et al. | |
| 2002/0171376 | A1 | 11/2002 | Rust et al. | |
| 2002/0180380 | A1 | 12/2002 | Lin | |
| 2002/0180572 | A1 | 12/2002 | Kakehashi et al. | |
| 2002/0181260 | A1 | 12/2002 | Chou et al. | |
| 2002/0195971 | A1 | 12/2002 | Qian et al. | |
| 2003/0001524 | A1 | 1/2003 | Lin et al. | |
| 2003/0020677 | A1 | 1/2003 | Nakano | |
| 2003/0025462 | A1 | 2/2003 | Weindorf | |
| 2003/0080695 | A1 | 5/2003 | Ohsawa | |
| 2003/0090913 | A1 | 5/2003 | Che-Chen et al. | |
| 2003/0117084 | A1 | 6/2003 | Stack | |
| 2003/0141829 | A1 | 7/2003 | Yu | |
| 2003/0161164 | A1 | 8/2003 | Shannon et al. | |
| 2003/0227435 | A1 | 12/2003 | Hsieh | |
| 2004/0012556 | A1 | 1/2004 | Yong et al. | |
| 2004/0017348 | A1 | 1/2004 | Numao | |
| 2004/0032223 | A1 | 2/2004 | Henry | |
| 2004/0051473 | A1 | 3/2004 | Jales et al. | |
| 2004/0145558 | A1 | 7/2004 | Cheng | |
| 2004/0155853 | A1* | 8/2004 | Lin | 345/102 |
| 2004/0189217 | A1 | 9/2004 | Ishihara et al. | |
| 2004/0257003 | A1 | 12/2004 | Hsieh et al. | |
| 2004/0263092 | A1 | 12/2004 | Liu | |
| 2005/0062436 | A1 | 3/2005 | Jin | |
| 2005/0093471 | A1 | 5/2005 | Jin | |
| 2005/0093472 | A1 | 5/2005 | Jin | |
| 2005/0093482 | A1 | 5/2005 | Ball | |
| 2005/0093483 | A1 | 5/2005 | Ball | |
| 2005/0093484 | A1 | 5/2005 | Ball | |
| 2005/0094372 | A1 | 5/2005 | Jin | |
| 2005/0099143 | A1 | 5/2005 | Kohno | |
| 2005/0156536 | A1 | 7/2005 | Ball | |
| 2005/0156539 | A1 | 7/2005 | Ball | |
| 2005/0156540 | A1 | 7/2005 | Ball | |
| 2005/0162098 | A1 | 7/2005 | Ball | |
| 2005/0218825 | A1 | 10/2005 | Chiou | |
| 2005/0225261 | A1 | 10/2005 | Jin | |
| 2006/0022612 | A1 | 2/2006 | Henry | |
| 2006/0049959 | A1* | 3/2006 | Sanchez | 340/855.3 |

FOREIGN PATENT DOCUMENTS

| | | |
|---|---|---|
| EP | 0587923 | 3/1994 |
| EP | 0597661 | 5/1994 |
| EP | 0647021 | 9/1994 |
| JP | 06168791 | 6/1994 |
| JP | 8-204488 | 8/1996 |
| KR | 10-2003-0075461 | * 10/2003 |
| TW | 554643 | 9/2003 |
| TW | 8-20448 | 12/2003 |
| TW | 200501829 | 1/2005 |
| WO | WO 94/15444 | 7/1994 |
| WO | WO 98/09369 | 3/1998 |
| WO | WO 9941953 | 8/1999 |
| WO | WO 0237904 | 5/2002 |

OTHER PUBLICATIONS

Tannas, Lawrence, "Flat Panet Displays and CRTs". © 1985 Van Nostrand Reinhold Company Inc., pp. 96-99.

Jordan et al., Resonant Fluorescent Lamp Converter Provides Efficient and Compact Solution, Mar. 1993, pp. 424-431.

Unitrode Datasheet, Resonant Fluorescent Lamp Driver, UC 1871/2871/3871, May 1993, pp. 1-6.

Unitrode Product & Applications Handbook 1993-94, U-141, Jun. 1993, pp. i-ii; 9-471-9-478.

Williams, Jim, Techniques for 92% Efficient LCD Illumination, Linear Technology Application Note 55, Aug. 1993.

Unitrode Datasheet, Resonant Fluorescent Lamp Driver, UC 1871/2871/3871, Oct. 1994, pp. 1-6.

O'Connor, J., Dimmable Cold-Cathode Fluorescent Lamp Ballast Design Using the UC3871, Application Note U-148, pp. 1-15, 1995.

Goodenough, Frank, DC-to-AC Inverter Ups CCFL Lumens Per Watt, Electronic Design, Jul. 10, 1995, pp. 143-148.

Coles, Single Stage CCFL Backlight Resonant Inverter using PWM Dimming Methods, 1998, pp. 35-38.

Micro Linear, ML4878 Single-Stage CCFL Backlight Resonant Inverter, Application Note 68, May 1998, pp. 1-12.

Plaintiff O2 Micro International Limited's Preliminary Invalidity Contentions re Third-Party Defendant Microsemi Corporation Patents, dated Sep. 14, 2007.

Third-Party Defendant Microsemi Corporation's Brief in Support of its Claim Construction for U.S. Patent Nos. 5,930,121 and 6,198,234, dated Oct. 19, 2007.

Declaration of Irfan A. Lateef in Support of Third-Party Defendant Microsemi Corporation's Brief in Support of its Claim Construction for U.S. Patent Nos. 5,930,121 and 6,198,234, dated Oct. 19, 1997.

Plaintiff O2 Micro International Limited's Brief in Response to Third-Party Defendant Microsemi Corporation's Brief Re Claim Construction for U.S. Patent Nos. 5,930,121 and 6,198,234, dated Oct. 26, 2007.

Declaration of Henry C. Su in Support of Plaintiff 02 Micro International Limited's Brief in Response to Third-Party Defendant Microsemi Corporation's Brief Re Claim Construction for U.S. Patent Nos. 5,930,121 and 6,198,234, dated Oct. 26, 2007.

Defendant/Counterclaimant Monolithic Power Systems, Inc's Notice of Motion and Motion for Summary Judgement of Invalidity of Asserted Claims of U.S. Patent No. 6,198,234, dated Nov. 14, 2005.

Defendant/Counterclaimant Monolithic Power Systems, Inc.'s Memorandum of Points and Authorities in Support of Motion for Summary Judgment of Unvalidity of Asserted Claims of U. S. Patent No. 6,198,234, dated Nov. 14, 2005.

Declaration of Robert Mammano filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Declaration of John A. O'Connor filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Declaration of Defendant/Counterclaimant Monolithic Power Systems, Inc.'s Expert Witness, Dr. Douglas C. Hopkins, In Support of Its Motion for Summary Judgment of Invalidity of Asserted Claims of U. S. Patent No. 6,198,234, dated Nov. 14, 2005.

Declaration of Doyle Slack filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Declaration of Dean G. Dunlavey filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Declaration of Charles Coles filed by Defendant/Counterclaimant Monolithic Power Systems, Inc.'s In Support of Its Motion for Summary Judgment of Invalidity of Asserted Claims of U. S. Patent No. 6,198,234, dated Nov. 14, 2005.

Plaintiff Microsemi Corporation's Opposition to Defendant/Counterclaimant Monolithic Power Systems, Inc.'s Motion for Summary Judgment of Invalidity of Asserted Claims of U. S. Patent No. 6,198,234, dated Feb. 13, 2006.

Plaintiff Microsemi Corporation's Statement of Genuine Issues in Opposition to Defendant/Counterclaimant Monolithic Power Systems, Inc.'s Motion for Summary Judgment of Invalidity of Asserted Claims of U. S. Patent No. 6,198,234, dated Feb. 13, 2006.

Defendant/Counterclaimant Monolithic Power Systems, Inc.'s Reply Brief in Support of Motion for Summary Judgment of Invalidity of Asserted Claims of U. S. Patent No. 6,198,234, dated Mar. 13, 2006.
Supplemental Declaration of Dean G. Dunlavey filed by Defendant/Counterclaimant Monolithic Power Systems, Inc.'s In Support of Its Motion for Summary Judgment of Invalidity of Asserted Claims of U. S. Patent No. 6,198,234, dated Mar. 13, 2006.
Defendant/Counterclaimant Monolithic Power Systems, Inc.'s Notice of Motion for Summary Judgment of Invalidity of Asserted Claims of U. S. Patent No. 5,615,093, dated Nov. 14, 2005.
Defendant/Counterclaimant Monolithic Power Systems, Inc.'s Memorandum of Points and Authorities in Support of Motion for Summary Judgment of Invalidity of Asserted Claims of U. S. Patent No. 5,615,093, dated Nov. 14, 2005
Plaintiff Microsemi Corporation's Opposition to Defendant/Counterclaimant Monolithic Power Systems, Inc.'s Motion for Summary Judgment of Invalidity of Asserted Claims of U. S. Patent No. 5,615,093, dated Feb. 13, 2006.
Plaintiff Microsemi Corporation's Statement of Genuine Issues in Opposition to Defendant/Counterclaimant Monolithic Power Systems, Inc.'s Motion for Summary Judgment of Invalidity of Asserted Claims of U. S. Patent No. 5,615,093, dated Feb. 13, 2006.
Defendant/Counterclaimant Monolithic Power Systems, Inc.'s Reply Brief in Support of Motion for Summary Judgment of Invalidity of Asserted Claims of U. S. Patent No. 5,615,093, dated Mar. 13, 2006.
PCT International Search Report and Written Opinion mailed Apr. 8, 2008, Appl. No. PCT/US2007/072862 in 12 pages.
Williams, B.W.; "Power Electronics Devices, Drivers, Applications and Passive Components"; Second Edition, McGraw-Hill, 1992; Chapter 10, pp. 218-249.
Bradley, D.A., "Power Electronics" 2nd Edition; Chapman & Hall, 1995; Chapter 1, pp. 1-38.
Dubey, G. K., "Thyristorised Power Controllers"; Halsted Press, 1986; pp. 74-77.
IEEE Publication, "Duel Switched Mode Power Converter": Pallab Midya & Fred H. Schlereth; p. 155 1989.
IEEE Publication, "High Frequency Resonant Inverter For Group Dimming Control of Fluorescent Lamp Lighting Systems", K.H. Jee, et al., 1989 149-154.
Int. J. Electronics, "New soft-switching invertor for high efficiency electronic ballast with simple structure" E.C. Nho, et al., 1991, vol. 71, No. 3, 529-541.

* cited by examiner

METHOD AND APPARATUS TO CONTROL DISPLAY BRIGHTNESS WITH AMBIENT LIGHT CORRECTION

CLAIM FOR PRIORITY

This application claims the benefit of priority under 35 U.S.C. § 119(e) of U.S. Provisional Application No. 60/543,094, filed on Feb. 9, 2004, and entitled "Information Display with Ambient Light Correction," the entirety of which is incorporated herein by reference.

BACKGROUND OF THE INVENTION

1. Field of the Invention

The present invention relates to brightness control in a visual information display system, and more particularly relates to adjusting the brightness level to compensate for changes in ambient lighting.

2. Description of the Related Art

Backlight is needed to illuminate a screen to make a visible display in liquid crystal display (LCD) applications. The ability to read the display is hampered under conditions of high ambient room lighting. Ambient lighting reflects off the surface of the LCD and adds a bias to the light produced by the LCD, which reduces the display contrast to give the LCD a washed-out appearance. The condition can be improved by increasing the brightness of the backlight for the LCD, thereby making the light provided by the LCD brighter in comparison to the reflected light off the LCD surface. Thus, the backlight should be adjusted to be brighter for high ambient lighting conditions and less bright for low ambient lighting conditions to maintain consistent perceived brightness.

In battery operated systems, such as notebook computers, it is advantageous to reduce power consumption and extend the run time on a battery between charges. One method of reducing power consumption, and therefore extending battery run time, is to reduce the backlight brightness of a LCD under low ambient lighting conditions. The backlight can operate at a lower brightness level for low ambient lighting conditions because light reflections caused by the ambient light are lower and produce less of a washed-out effect. It is also advantageous to turn down the backlight under low ambient lighting conditions to extend the life of light sources in the backlight system. Typically, the light sources have a longer lifetime between failures if they run at lower brightness levels.

In some LCD applications, an ambient light sensor is used in a closed-loop configuration to adjust the backlight level in response to the ambient light level. These systems usually do not take into account user preferences. These systems are crude in implementation and do not adapt well to user preferences which may vary under various levels of eye fatigue.

SUMMARY OF THE INVENTION

In one embodiment, the present invention is a light sensor control system that provides the capability for a fully automatic and fully adaptable method of adjusting display brightness in response to varying ambient lighting conditions in combination with various user preferences. For example, the mathematical product of a light sensor output and a user selectable brightness control can be used to vary backlight intensity in LCD applications. Using the product of the light sensor output and the user selectable brightness control advantageously offers noticeable user dimming in bright ambient levels. Power is conserved by automatically dimming the backlight in low ambient light levels. The user control feature allows the user to select a dimming contour which works in conjunction with a visible light sensor.

In one embodiment, software algorithm can be used to multiply the light sensor output with the user selectable brightness control. In another embodiment, analog or mixed-signal circuits can be used to perform the multiplication. Digitizing the light sensor output or digital processing to combine the user brightness contour selection with the level of ambient lighting is advantageously not needed. The light sensor control system can be autonomous to a processor for a display device (e.g., a main processor in a computer system of a LCD device).

In one embodiment, a backlight system with selective ambient light correction allows a user to switch between a manual brightness adjustment mode and an automatic brightness adjustment mode. In the manual mode, the user's selected brightness preference determines the backlight brightness, and the user dims or increases the intensity of the backlight as the room ambient light changes. In the automatic mode, the user adjusts the brightness level of the LCD to a desired level, and as the ambient light changes, the backlight automatically adjusts to make the LCD brightness appear to stay consistent at substantially the same perceived level. The automatic mode provides better comfort for the user, saves power under low ambient lighting conditions, and prevents premature aging of light sources in the backlight system.

The mathematical product of a light sensor output and a user selectable brightness control can be similarly used to vary brightness in cathode ray tube (CRT) displays, plasma displays, organic light emitting diode (OLED) displays, and other visual information display systems that do not use backlight for display illumination. In one embodiment, a brightness control circuit with ambient light correction includes a visible light sensor that outputs a sensor current signal in proportion to the level of ambient light, a dimming control input determined by a user, and a multiplier circuit that generates a brightness control signal based on a mathematical product of the sensor current signal and the dimming control input. The brightness control signal is provided to a display driver (e.g., an inverter) to adjust brightness levels of one or more light sources, such as cold cathode fluorescent lamps (CCFLs) or light emitting diodes (LEDs) in a backlight system. The brightness control circuit with ambient light correction advantageously improves ergonomics by maintaining consistent brightness as perceived by the human eye. The brightness control circuit with ambient light correction also reduces power consumption to extend battery life and reduces stress on the light sources to extend product life at low ambient light levels.

In various embodiments, the brightness control circuit further includes combinations of a dark level bias circuit, an overdrive clamp circuit, or an automatic shutdown circuit. The dark level bias circuit maintains the brightness control signal above a predetermined level when the ambient light level decreases to approximately zero. Thus, the dark level bias circuit ensures a predefined (or minimum) brightness in total ambient darkness. The overdrive clamp circuit limits the brightness control signal to be less than a predetermined level. In one embodiment, the overdrive clamp circuit facilitates compliance with input ranges for the display driver. The automatic shutdown circuit turns off the light sources when the ambient light is greater than a predefined level. For example, the automatic shutdown circuit saves power by turning off auxiliary light sources when ambient light is sufficient to illuminate a transflective display.

The visible light sensor changes (e.g., increases or decreases) linearly with the level of ambient light and advantageously has a spectral response that approximates the spectral response of a human eye. In one embodiment, the visible light sensor uses an array of PIN diodes on a single substrate to detect ambient light. For example, an initial current in proportion to the ambient light level is generated from taking the difference between outputs of a full spectrum PIN diode and an infrared sensitive PIN diode. The initial current is amplified by a series of current mirrors to be the sensor current signal. In one embodiment, the initial current is filtered (or bandwidth limited) before amplification to adjust the response time of the visible light sensor. For example, a capacitor can be used to filter the initial current and to slow down the response time of the visible light sensor such that the sensor current signal remain substantially unchanged during transient variations in the ambient light (e.g., when objects pass in front of the display).

In one embodiment, the dimming control input is a pulse-width-modulation (PWM) logic signal that a user can vary from 0%-100% duty cycle. The PWM logic signal can be generated by a microprocessor based on user preference. In one embodiment, the dimming control input indicates user preference using a direct current (DC) signal. The DC signal and a saw-tooth ramp signal can be provided to a comparator to generate an equivalent PWM logic signal. The user preference can also be provided in other forms, such as a potentiometer setting or a digital signal (e.g., a binary word).

As discussed above, the multiplier circuit generates the brightness control signal using a multiplying function to correct for ambient light variations. The brightness control signal takes into account both user preference and ambient light conditions. The brightness control signal is based on the mathematical product of respective signals representing the user preference and the ambient light level.

In one embodiment, the multiplier circuit includes a pair of current steering diodes to multiply the sensor current signal with a PWM logic signal representative of the user preference. The sensor current signal is provided to a network of resistors when the PWM logic signal is high and is directed away from the network of resistors when the PWM logic signal is low. The network of resistors generates and scales the brightness control signal for the backlight driver. At least one capacitor is coupled to the network of resistors and configured as a low pass filter for the brightness control signal.

In one embodiment in which the user preference is indicated by a potentiometer setting, the visible light sensor output drives a potentiometer to perform the mathematical product function. For example, an isolation diode is coupled between the visible light sensor output and the potentiometer. The potentiometer conducts a portion of the sensor current signal to generate the brightness control signal. A network of resistors can also be connected to the potentiometer to scale the brightness control signal. An optional output capacitor can be configured as a low pass filter for the brightness control signal.

In one embodiment in which the user preference is indicated by a digital word, the multiplier circuit includes a digital-to-analog converter (DAC) to receive the digital word and output a corresponding analog voltage as the brightness control signal. The sensor current signal from the visible light sensor is used to generate a reference voltage for the DAC. For example, an isolation diode is coupled between the visible light sensor and a network of resistors. The network of resistors conducts the sensor current signal to generate the reference voltage. An optional capacitor is coupled to the network of resistors as a low pass filter for the reference voltage. The DAC multiplies the reference voltage by the input digital word to generate the analog voltage output.

For the purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE EMBODIMENTS

Figure 1:
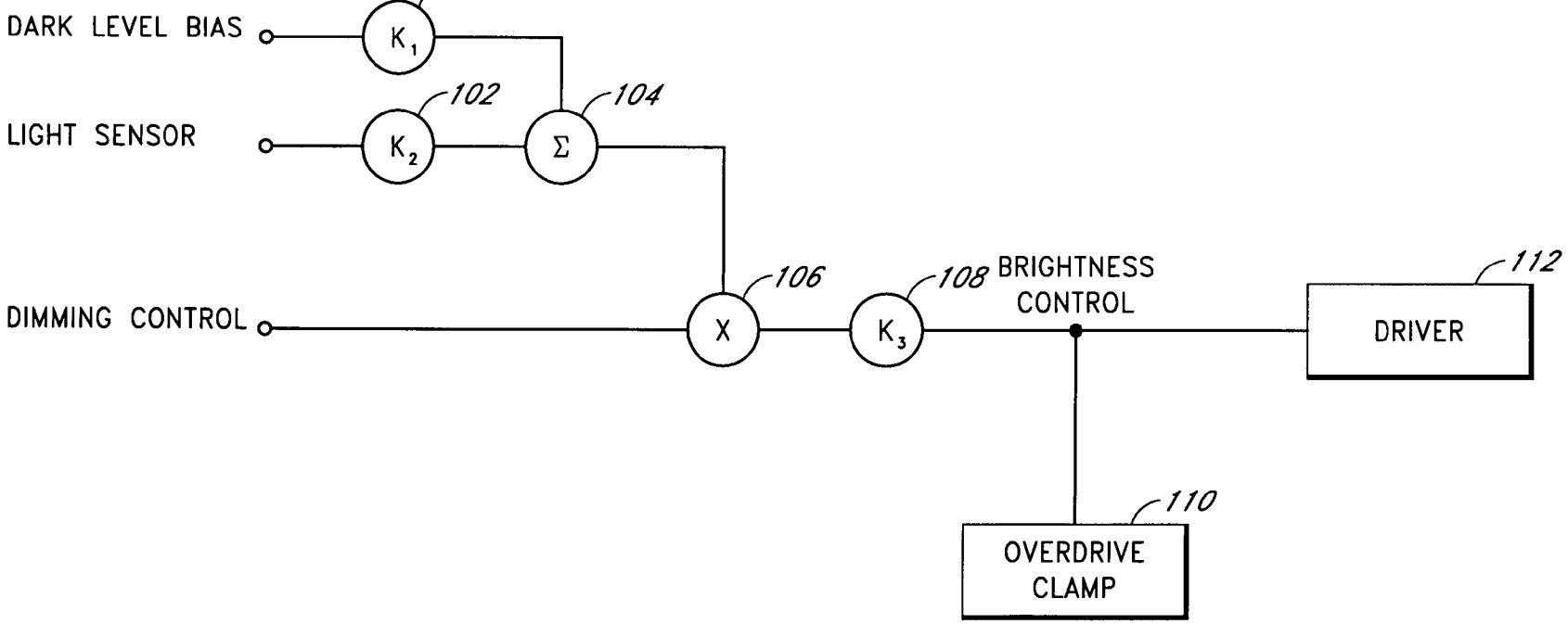
FIG. 1 is a block diagram of one embodiment of a brightness control circuit with ambient light correction.

Embodiments of the present invention will be described hereinafter with reference to the drawings. FIG. 1 is a block diagram of one embodiment of a brightness control circuit with ambient light correction. A user input (DIMMING CONTROL) is multiplied by a sum of a dark level bias (DARK LEVEL BIAS) and a light sensor output (LIGHT SENSOR) to produce a brightness control signal (BRIGHTNESS CONTROL) for a display driver 112. In one configuration, the dark level bias and the light sensor output are adjusted by respective scalar circuits (k1, k2) 100, 102 before being added by a summing circuit 104. An output of the summing circuit 104 and the user input is provided to a multiplier circuit 106. An output of the multiplier circuit 106 can be adjusted by a third scalar circuit (k3) 108 to produce the brightness control signal. An overdrive clamp circuit 110 is coupled to the brightness control signal to limit its amplitude range at the input of the display driver 112.

The display driver 112 can be an inverter for fluorescent lamps or a LED driver that controls backlight illumination of LCDs in portable electronic devices (e.g., notebook computers, cell phones, etc.), automotive displays, electronic dashboards, television, and the like. The brightness control circuit with ambient light correction provides closed-loop adjustment of backlight brightness due to ambient light variations to maintain a desired LCD brightness as perceived by the human eye. The brightness control circuit advantageously reduces the backlight brightness under low ambient light conditions to improve efficiency. A visible light sensor detects the ambient light level and generates the corresponding light sensor output. The user input can come from processors in LCD devices. The brightness control circuit with ambient light correction advantageously operates independently of the processors in the LCD devices. The display driver 112 can also be used to control display brightness in CRT displays, plasma displays, OLED displays, and other visual information display systems that do not use backlight for display illumination.

Figure 2:
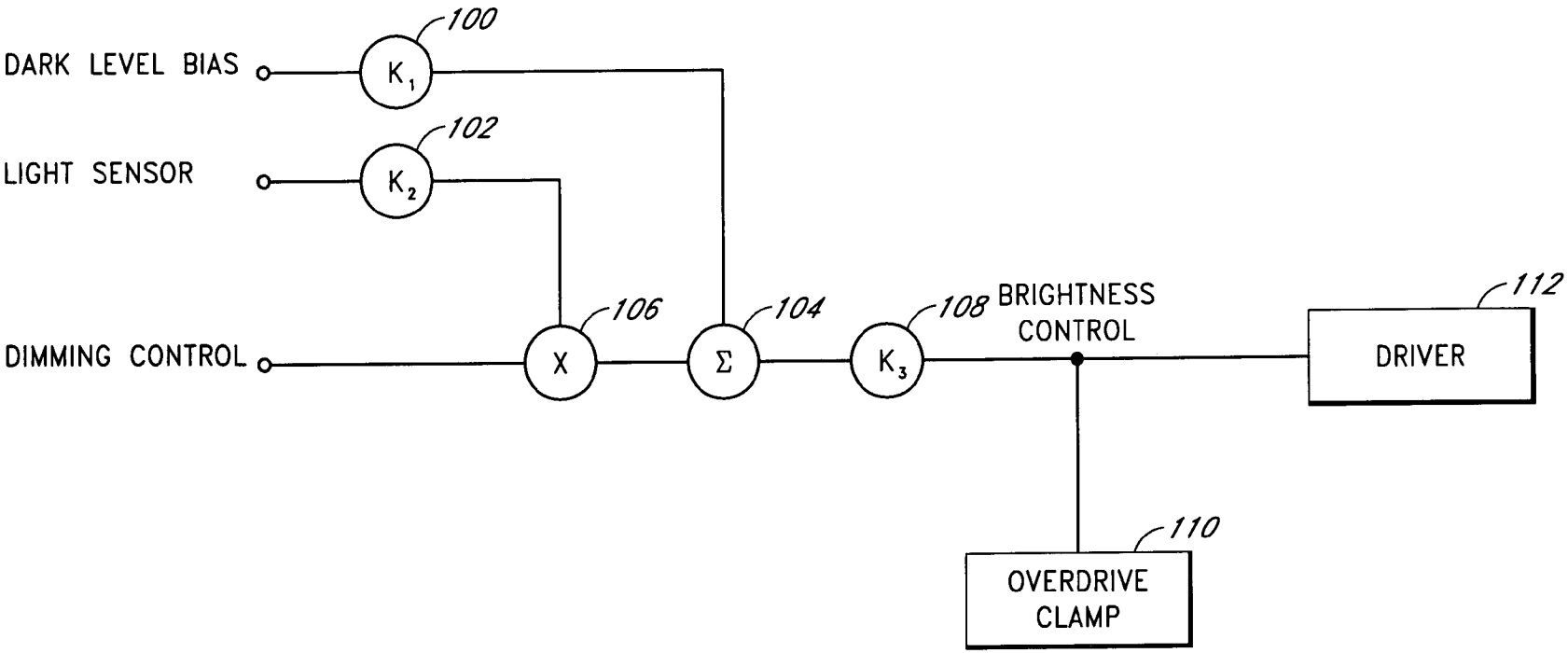
FIG. 2 is a block diagram of another embodiment of a brightness control circuit with ambient light correction.

FIG. 2 is a block diagram of another embodiment of a brightness control circuit with ambient light correction. A light sensor output (LIGHT SENSOR) is adjusted by a scalar circuit (k2) 102 and then provided to a multiplier circuit 106. A user input (DIMMING CONTROL) is also provided to the multiplier circuit 106. The multiplier circuit 106 outputs a signal that is the product of the user input and scaled light sensor output. A summing circuit 104 adds the product to a dark level bias (DARK LEVEL BIAS) that has been adjusted by scalar circuit (k1) 100. An output of the summing circuit 104 is adjusted by scalar circuit (k3) 108 to generate a brightness control signal (BRIGHTNESS CONTROL) for a display driver 112. An overdrive clamp 110 is coupled to the brightness control signal to limit its amplitude range at the input of the display driver 112.

The brightness control circuits shown in both FIGS. 1 and 2 automatically adjust the level of the brightness control signal in response to varying ambient light. The configuration of FIG. 2 provides a predefined level of brightness in substantially total ambient darkness and independent of the user input. For example, the output of the multiplier circuit 106, in both FIGS. 1 and 2, is substantially zero if the user input is about zero. The multiplier circuit 106 can be implemented using software algorithm or analog/mixed-signal circuitry. In FIG. 2, the scaled dark level bias is added to the output of the multiplier circuit 106 to provide the predefined level of brightness in this case. This feature may be desired to prevent a user from using the brightness control circuit to turn off a visual information display system.

Figure 3:
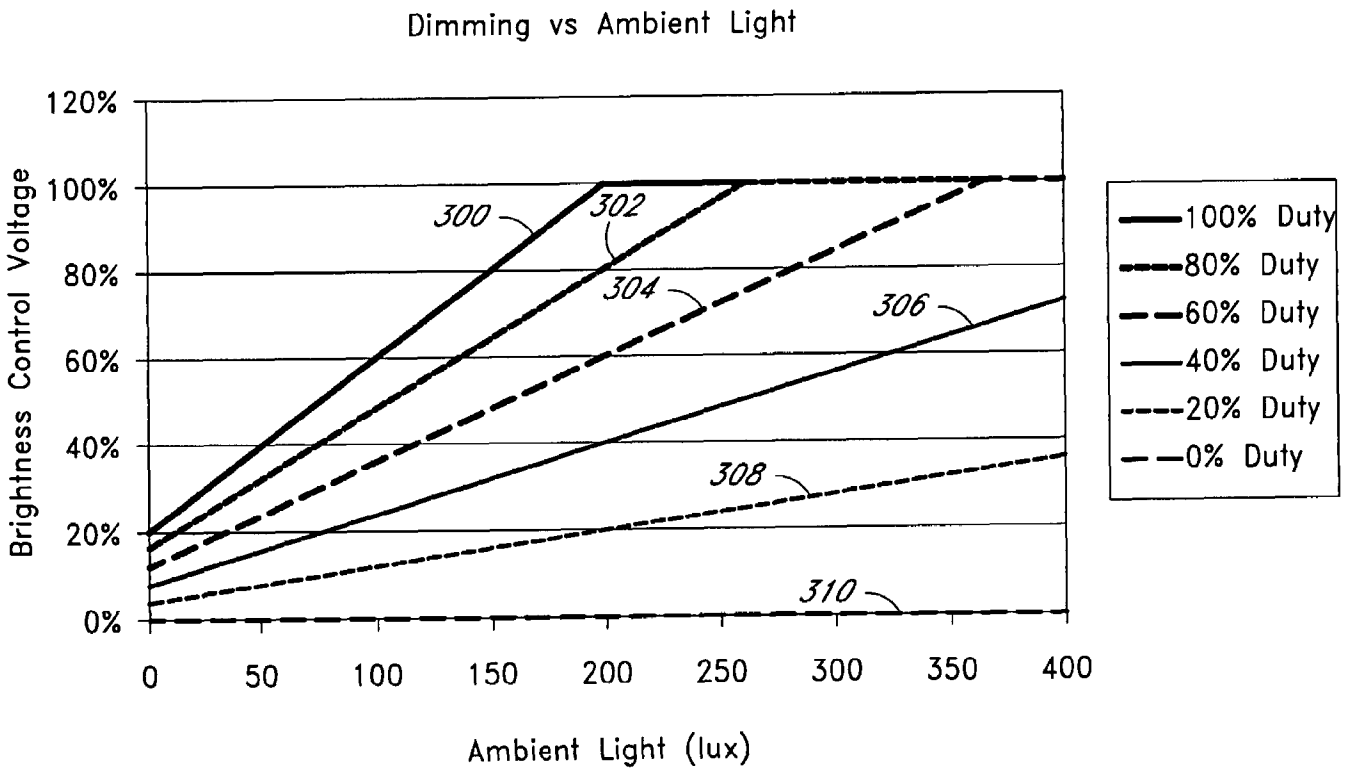
FIG. 3 illustrates brightness control signals as a function of ambient light levels for different user settings.

FIG. 3 illustrates brightness control signals as a function of ambient light levels for different user settings in accordance with the brightness control circuit of FIG. 1. For example, ambient light levels are indicated in units of lux (or lumens/square meter) on a horizontal axis (or x-axis) in increasing order. Brightness control signal levels are indicated as a percentage of a predefined (or full-scale) level on a vertical axis (or y-axis).

Graph 300 shows a first brightness control signal as a function of ambient light level given a first user setting (e.g., 100% duty cycle PWM dimming input). Graph 302 shows a second brightness control signal as a function of ambient light level given a second user setting (e.g., 80% duty cycle PWM dimming input). Graph 304 shows a third brightness control signal as a function of ambient light level given a third user setting (e.g., 60% duty cycle PWM dimming input). Graph 306 shows a fourth brightness control signal as a function of ambient light level given a fourth user setting (e.g., 40% duty cycle PWM dimming input). Graph 308 shows a fifth brightness control signal as a function of ambient light level given a fifth user setting (e.g., 20% duty cycle PWM dimming input). Finally, graph 310 shows a sixth brightness control signal as a function of ambient light level given a sixth user setting (e.g., 0% duty cycle PWM dimming input).

Graph 310 lies substantially on top of the horizontal axis in accordance with the sixth user setting corresponding to turning off the visual information display system. For the other user settings (or user adjustable dimming levels), the brightness control signal increases (or decreases) with increasing (or decreasing) ambient light levels. The rate of increase (or decrease) depends on the user setting. For example, higher user settings cause the associated brightness control signals to increase faster as a function of ambient light level. The brightness control signal near zero lux is a function of a dark bias level and also depends on the user setting. In one embodiment, the brightness control signal initially increases linearly with increasing ambient light level and reaches saturation (or 100% of full-scale) after a predetermined ambient light level. The saturation point is different for each user setting. For example, the brightness control signal begins to saturate at about 200 lux for the first user setting, at about 250 lux for the second user setting, and at about 350 lux for the third user setting. The brightness control circuit can be designed for different saturation points and dark bias levels.

Figure 4:
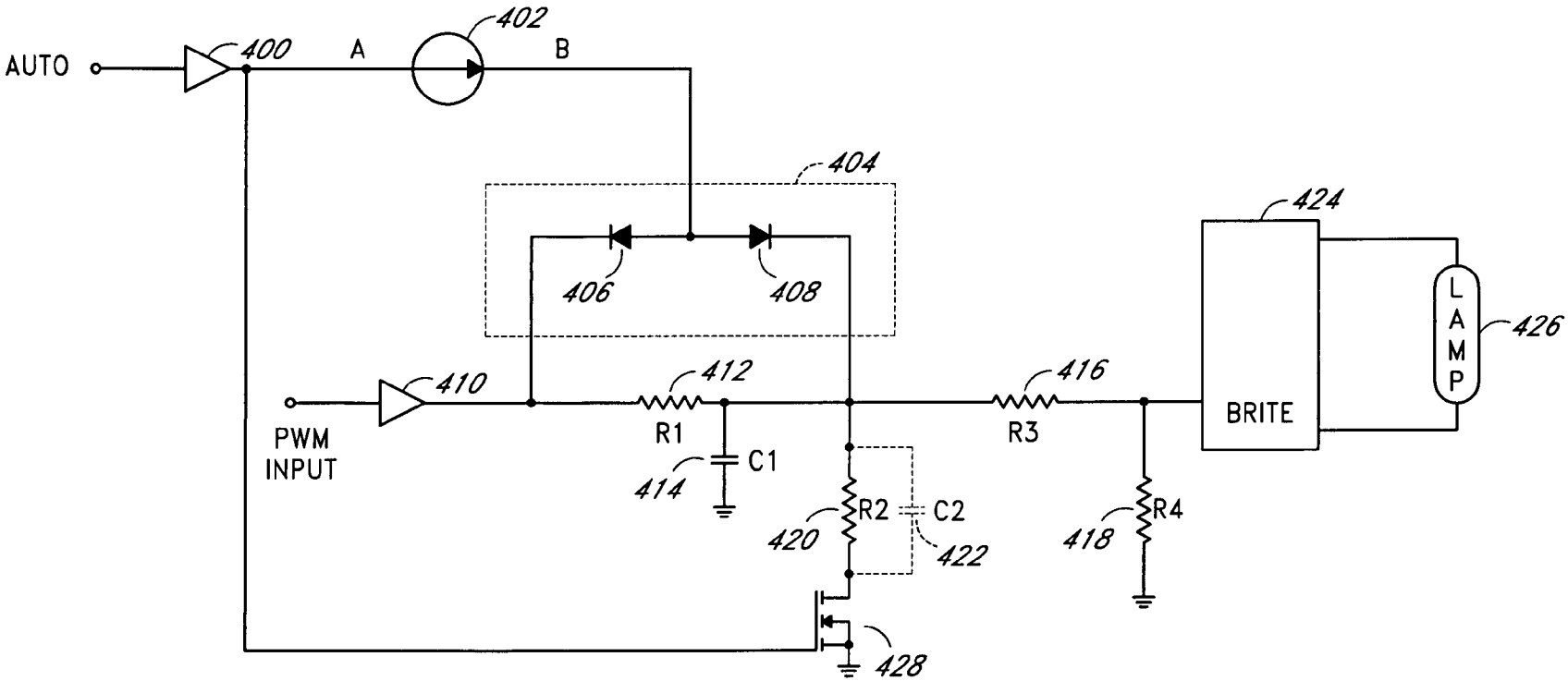
FIG. 4 is a schematic diagram of one embodiment of a brightness control circuit with a multiplier circuit to combine a light sensor output with a user adjustable PWM logic signal.

FIG. 4 is a schematic diagram of one embodiment of a brightness control circuit with a multiplier circuit to combine a light sensor output with a user adjustable PWM logic signal (PWM INPUT). For example, the user adjustable PWM logic signal varies in duty cycle from 0% for minimum user-defined brightness to 100% for maximum user-defined brightness. A microprocessor can generate the user adjustable PWM logic signal based on user input which can be adjusted in response to various levels of eye fatigue for optimal viewing comfort. In one embodiment, the user adjustable PWM logic signal is provided to an input buffer circuit 410.

The brightness control circuit includes a visible light sensor 402, a pair of current-steering diodes 404, a network of resistors (R1, R2, R3, R4) 412, 420, 416, 418, a filter capacitor (C1) 414, and an optional smoothing capacitor (C2) 422. In one embodiment, the brightness control circuit selectively operates in a manual mode or an auto mode. The manual mode excludes the visible light sensor 402, while the auto mode includes the visible light sensor 402 for automatic adjustment of display brightness as ambient light changes. An enable signal (AUTO) selects between the two modes. For example, the enable signal is provided to a buffer circuit 400. An output of the buffer circuit 400 is coupled to an input (A) of the visible light sensor 402. The output of the buffer circuit 400 is also provided to a gate terminal of a metal-oxide-semiconductor field-effect-transistor (MOSFET) switch 428. The MOSFET switch 428 is an n-type transistor with a source terminal coupled to ground and a drain terminal coupled to a first terminal of the second resistor (R2) 420.

The pair of current-steering diodes 404 includes a first diode 406 and a second diode 408 with commonly connected anodes that are coupled to an output (B) of the visible light sensor 402. The first resistor (R1) 412 is coupled between the respective cathodes of the first diode 406 and the second diode 408. An output of the input buffer circuit 410 is coupled to the cathode of the first diode 406. The filter capacitor 414 is coupled between the cathode of the second diode 408 and ground. A second terminal of the second resistor 420 is coupled to the cathode of the second diode 408. The optional smoothing capacitor 422 is coupled across the second resistor 420. The third and fourth resistors 416, 418 are connected in series between the cathode of the second diode 408 and ground. The commonly connected terminals of the third and fourth resistors 416, 418 provide a brightness control signal to an input (BRITE) of a display driver (e.g., a backlight driver) 424. In one embodiment, the display driver 424 delivers power to one or more light sources (e.g., fluorescent lamps) 426 coupled across its outputs.

In the auto mode, the enable signal is logic high and the buffer circuit 400 also outputs logic high (or VCC) to turn on the visible light sensor 402 and the MOSFET switch 428. The visible light sensor 402 outputs a sensor current signal in proportion to sensed ambient light level. The sensor current signal and the user adjustable PWM logic signal are multiplied using the pair of current-steering diodes 404. For example, when the user adjustable PWM logic signal is high, the sensor current signal flows through the second diode 408 towards the brightness control signal (or output). When the user adjustable PWM logic signal is low, the sensor current signal flows through the first diode 406 away from the output or into the input buffer circuit 410. The equation for the brightness control signal (BCS1) in the auto mode is:

$$BCS1 = dutycycle \times \left[\left(\frac{VCC \times R2 \times R4}{[(R1+R2)\times(R3+R3)]+(R1\times R2)}\right)+\left(\frac{ISRC \times R1 \times R2 \times R4}{[(R1+R2)\times(R3+R4)]+(R1\times R2)}\right)\right].$$

The term "dutycycle" corresponds to the duty cycle of the user adjustable PWM logic signal. The term "VCC" corresponds to the logic high output from the input buffer circuit 410. The term "ISRC" corresponds to the sensor current signal. The first major term within the brackets corresponds to a scaled dark bias level of the brightness control signal in total ambient darkness. The second major term within the brackets introduces the effect of the visible light sensor 402. The network of resistors 412, 420 416, 418 helps to provide the dark bias level and to scale the product of the sensor current signal and the user adjustable PWM logic signal.

For example, the first resistor 412 serves to direct some current from the input buffer circuit 410 to the output in total ambient darkness. The second, third, and fourth resistors 420, 416, 418 provide attenuation to scale the brightness control signal to be compatible with the operating range of the display driver 424. The filter capacitor 414 and the optional smoothing capacitor 422 slow down the response time of the backlight brightness control circuit to reduce flicker typically associated with indoor lighting sources. In the auto mode, the brightness control signal clamps when the voltage at the cathode of the second diode 408 approaches the compliance voltage of the visible light sensor 402 plus a small voltage drop across the second diode 408.

In the manual mode, the enable signal is logic low. Consequently, the visible light sensor 402 and the MOSFET switch 428 are off. The pair of current-steering diodes 404 isolates the visible light sensor 402 from the rest of the circuit. The off-state of the MOSFET switch 428 removes the influence of the second resistor 420 and the optional smoothing capacitor 422. The equation for the brightness control signal (BCS2) in the manual mode is:

$$BCS2 = VCC \times dutycycle \times \frac{R4}{(R1+R3+R4)}.$$

In the manual mode, the filter capacitor 414 filters the user adjustable PWM logic signal. The brightness control circuit has an option of having two filter time constants, one for the manual mode and one for the auto mode. The time constant for the manual mode is determined by the filter capacitor 414 in combination with the first, third and fourth resistors 412, 416, 418. The node impedance presented to the filter capacitor 414 is typically high during the manual mode. The time constant for the auto mode can be determined by the optional smoothing capacitor 422, which is typically larger in value, to slow down the response of the visible light sensor 402. The node impedance presented to the optional smoothing capacitor 422 is typically low. The optional smoothing capacitor 422 may be eliminated if the visible light sensor 402 is independently bandwidth limited.

Figure 5:
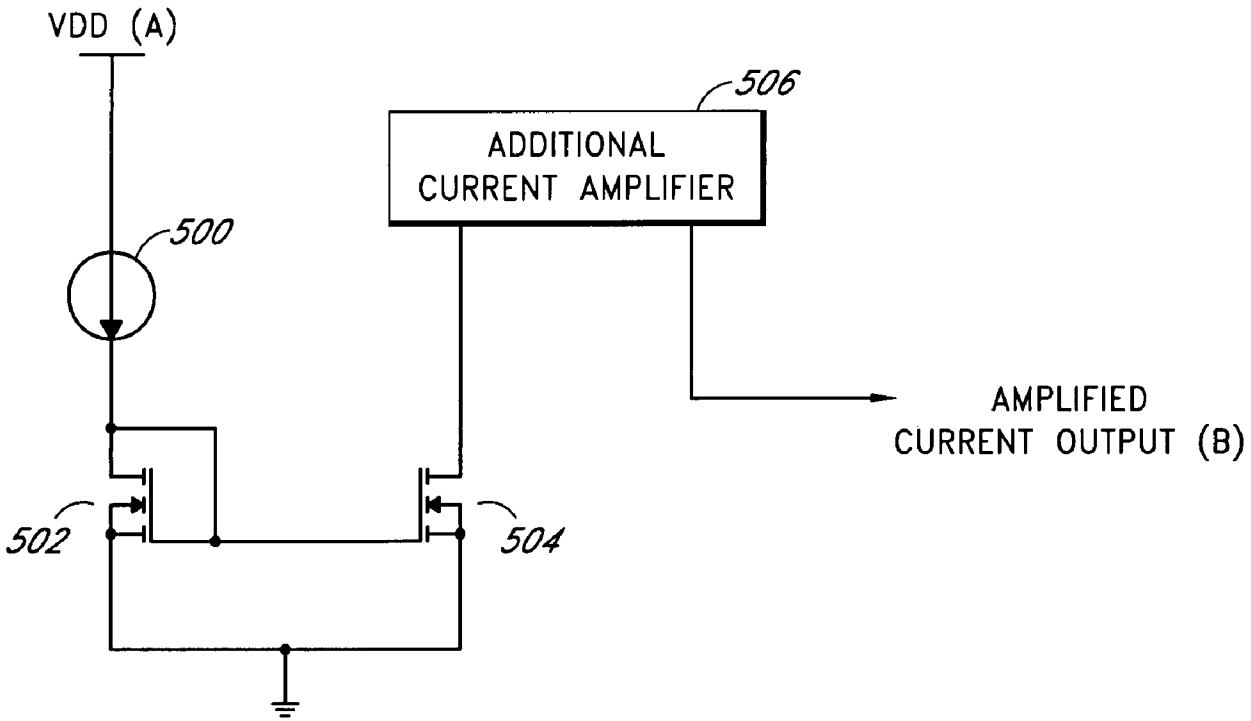
FIG. 5 illustrates one embodiment of an ambient light sensor.

FIG. 5 illustrates one embodiment of an ambient light sensor. The ambient light sensor includes a light detector 500, a first transistor 502, a second transistor 504 and an additional current amplifier circuit 506. The light detector 500 generates an initial current in response to sensed ambient light. The first transistor 502 and the second transistor 504 are configured as current mirrors to respectively conduct and duplicate the initial current. The second transistor 504 can also provide amplification of the duplicated initial current. The additional current amplifier circuit 506 provides further amplification of the current conducted by the second transistor 504 to generate a sensor current signal at an output of the ambient light sensor.

For example, the light detector (e.g., a photodiode or an array of PIN diodes) 500 is coupled between an input (or power) terminal (VDD) and a drain terminal of the first transistor 502. The first transistor 502 is an n-type MOSFET connected in a diode configuration with a source terminal coupled to ground. The first transistor 502 conducts the initial current generated by the light detector 500. The second transistor 504 is also an n-type MOSFET with a source terminal coupled to ground. Gate terminals of the first and second transistors 502, 504 are commonly connected. Thus, the second transistor 504 conducts a second current that follows the initial current and is scaled by the geometric ratios between the first and second transistors 502, 504. The additional current amplifier circuit 506 is coupled to a drain terminal of the second transistor 504 to provide amplification (e.g., by additional current mirror circuits) of the second current. The output of the additional current amplifier circuit 506 (i.e., the sensor current signal) is effectively a multiple of the initial current generated by the light detector 500.

Figure 6:
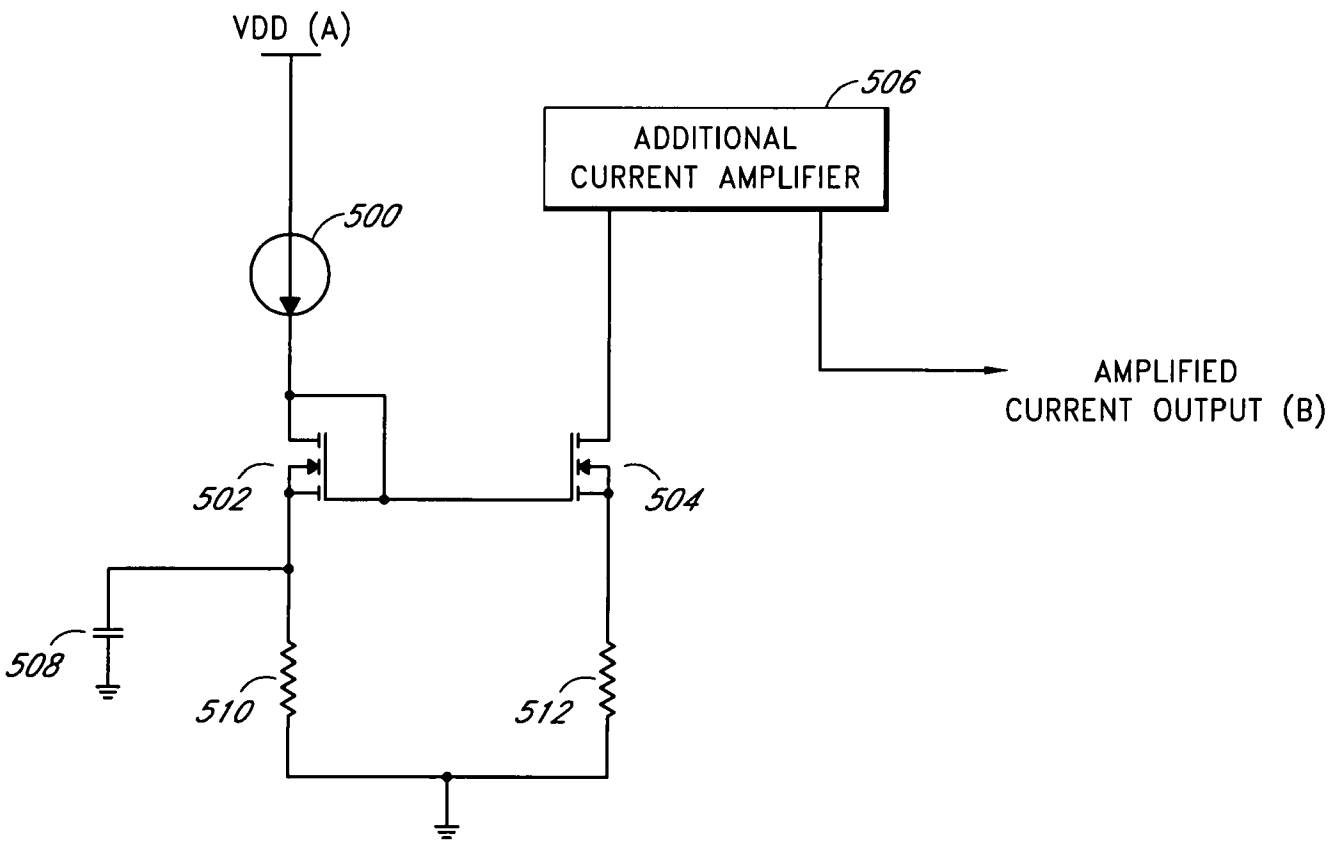
FIG. 6 illustrates one embodiment of an ambient light sensor with an adjustable response time.

FIG. 6 illustrates one embodiment of an ambient light sensor with an adjustable response time. The ambient light sensor of FIG. 6 is substantially similar to the ambient light sensor of FIG. 5 and further includes a program capacitor 508 and source degeneration resistors 510, 512. For example, the source degeneration resistors 510, 512 are inserted between ground and the respective source terminals of the first and second transistors 502, 504. The program capacitor 508 is coupled between the source terminal of the first transistor 502 and ground.

The program capacitor 508 filters the initial current generated by the light detector 500 and advantageously provides the ability to adjust the response time of the ambient light sensor (e.g., by changing the value of the program capacitor 508). In a closed loop system, such as automatic brightness control for a computer display or television, it may be desirable to slow down the response time of the ambient light sensor so that the automatic brightness control is insensitive to passing objects (e.g., moving hands or a person walking by). A relatively slower response by the ambient light sensor allows the automatic brightness control to transition between levels slowly so that changes are not distracting to the viewer.

The response time of the ambient light sensor can also be slowed down by other circuitry downstream of the ambient light sensor, such as the optional smoothing capacitor 422 in the brightness control circuit of FIG. 4. The brightness control circuit of FIG. 4 has two filter time constants, one for the manual mode in which the visible light sensor 402 is not used and another for the auto mode which uses the visible light sensor 402. In one embodiment, the optional smoothing capacitor 422 is included in the auto mode to slow down the response time of the brightness control circuit to accommodate the visible light sensor 402.

The optional smoothing capacitor 422 may have an unintentional side effect of slowing down the response time of the brightness control circuit to the user adjustable PWM logic signal. This unintentional side effect is eliminated by using the program capacitor 508 to separately and independently slow down the response time of the ambient light sensor to a desired level. The optional smoothing capacitor 422 can be eliminated from the brightness control circuit which then has one filter time constant for both the auto and manual modes.

The program capacitor 508 can be coupled to different nodes in the ambient light sensor to slow down response time. However, it is advantageous to filter (or limit the bandwidth of) the initial current rather than an amplified version of the initial current because the size and value of the program capacitor 508 can be smaller and lower, therefore more cost-efficient.

Figure 7:
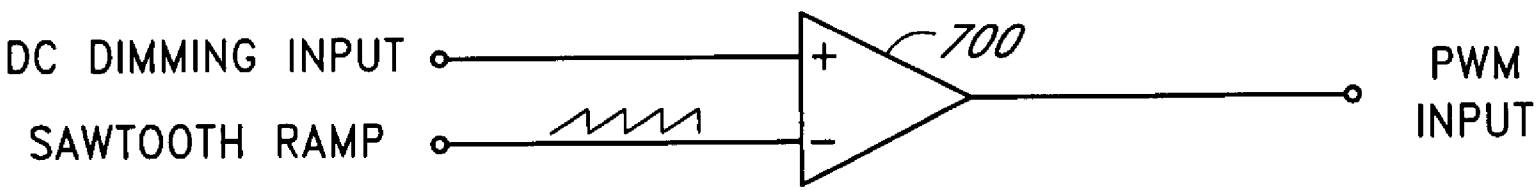
FIG. 7 illustrates conversion of a direct current signal to a PWM logic signal.

FIG. 7 illustrates conversion of a DC signal (DC DIMMING INPUT) to a PWM logic signal (PWM INPUT). The DC signal (or DC dimming interface) is used in some backlight systems to indicate user dimming preference. In one embodiment, a comparator 700 can be used to convert the DC signal to the PWM logic signal used in the brightness control circuit of FIG. 4. For example, the DC signal is provided to a non-inverting input of the comparator 700. A periodic saw-tooth signal (SAWTOOTH RAMP) is provided to an inverting input of the comparator 700. The periodic saw-tooth signal can be generated using a C555 timer (not shown). The comparator 700 outputs a PWM signal with a duty cycle determined by the level of the DC signal. Other configurations to convert the DC signal to the PWM logic signal are also possible.

Figure 8:
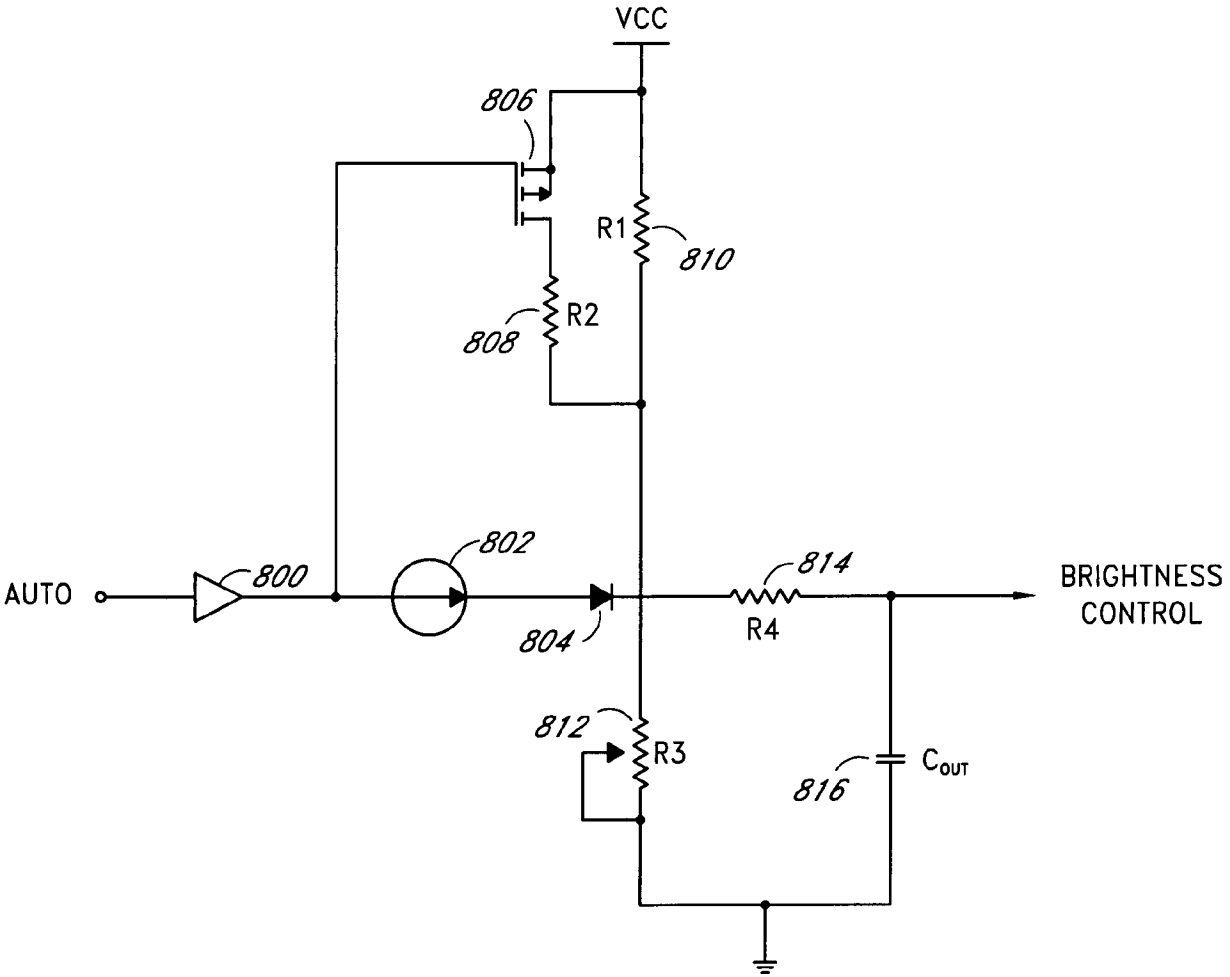
FIG. 8 is a schematic diagram of one embodiment of a brightness control circuit with a multiplier circuit to combine a light sensor output with a user adjustable potentiometer.

FIG. 8 is a schematic diagram of one embodiment of a brightness control circuit with a multiplier circuit to combine a light sensor output with a user adjustable potentiometer (R3) 812. Some display systems use the potentiometer 812 for user dimming control. The brightness control circuit configures a visible light sensor 802 to drive the potentiometer 812 with a current signal proportional to ambient light to generate a brightness control signal (BRIGHTNESS CONTROL) at its output.

For example, the potentiometer 812 has a first terminal coupled to ground and a second terminal coupled to a supply voltage (VCC) via a first resistor (R1) 810. A second resistor (R2) 808 in series with a p-type MOSFET switch 806 are coupled in parallel with the first resistor 810. The second terminal of the potentiometer 812 is also coupled to an output of visible light sensor 802 via an isolation diode 804. The isolation diode 804 has an anode coupled to the output of the visible light sensor 802 and a cathode coupled to the second terminal of the potentiometer 812. A fourth resistor (R4) 814 is coupled between the second terminal of the potentiometer 812 and the output of the brightness control circuit. A capacitor (Cout) 816 is coupled between the output of the brightness control circuit and ground.

In one embodiment, the brightness control circuit of FIG. 8 selectively operates in an auto mode or a manual mode. An enable signal (AUTO) indicates the selection of operating mode. The enable signal is provided to a buffer circuit 800, and an output of the buffer circuit 800 is coupled to an input of the visible light sensor 802 and a gate terminal of the p-type MOSFET switch 806. When the enable signal is logic high to indicate operation in the auto mode, the buffer circuit 800 turns on the visible light sensor 802 and disables (or turns off) the p-type MOSFET switch 806. Turning off the p-type MOSFET switch 806 effectively removes the second resistor 808 from the circuit. The equation for the brightness control signal (BCS3) at the output of the brightness control circuit during auto mode operation is:

$$BCS3 = \left[VCC \times \frac{R3}{(R1 + R3)}\right] + \left[ISRC \times \frac{(R1 \times R3)}{(R1 + R3)}\right].$$

The first major term in brackets of the above equation corresponds to the brightness control signal in total ambient darkness. The second major term in brackets introduces the effect of the visible light sensor 802. The maximum range for the brightness control signal in the auto mode is determined by the compliance voltage of the visible light sensor 802.

The enable signal is logic low to indicate operation in the manual mode, and the buffer circuit 800 turns off the visible light sensor 802 and turns on the p-type MOSFET switch 806. Turning on the p-type MOSFET switch 806 effectively couples the second resistor 808 in parallel with the first resistor 810. The equation for the brightness control signal (BCS4) at the output of the brightness control circuit during manual mode operation is:

$$BCS4 = VCC \times \frac{R3 \times (R1 + R2)}{(R1 \times R2) + (R1 \times R3) + (R2 \times R3)}.$$

Figure 9:
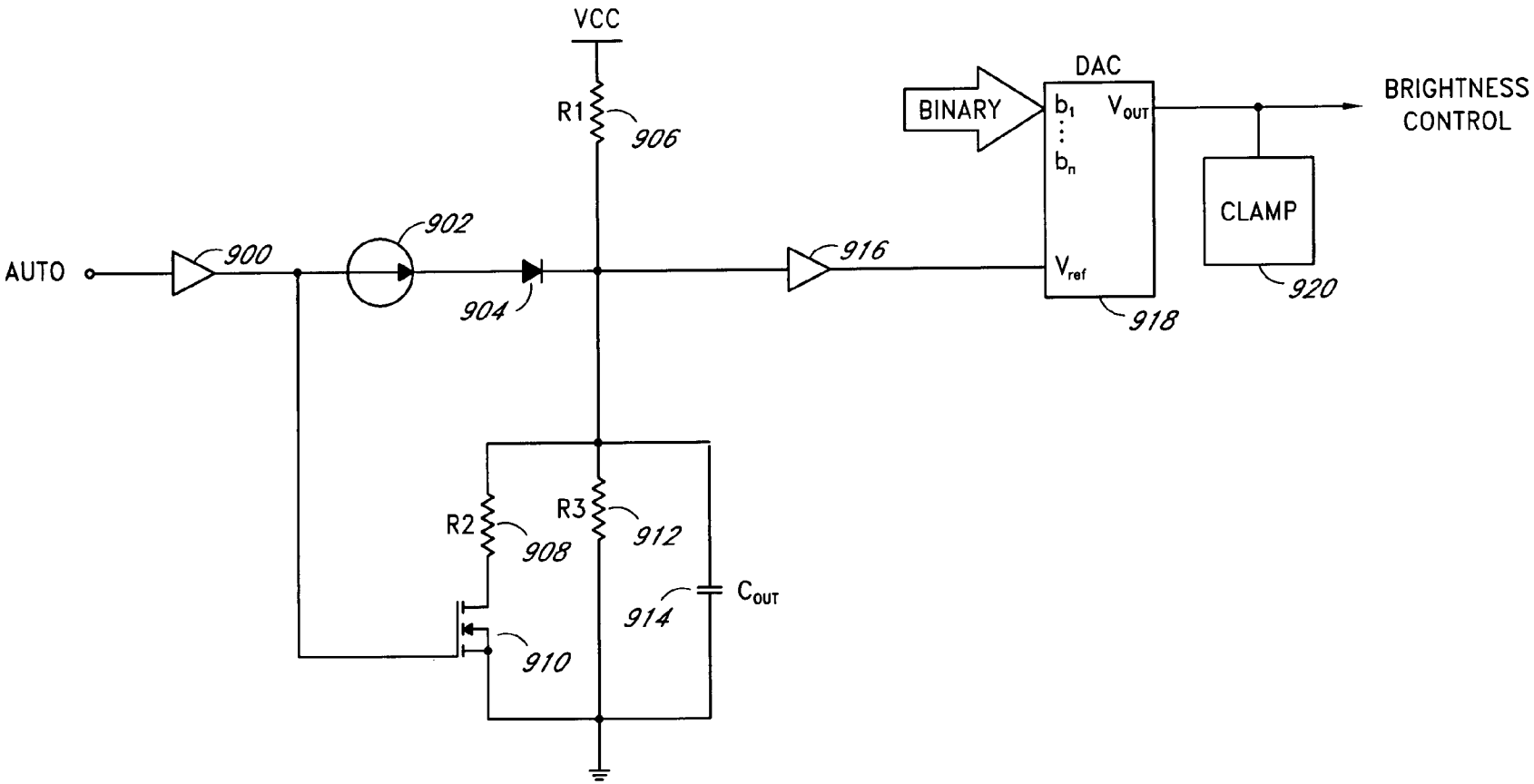
FIG. 9 is a schematic diagram of one embodiment of a brightness control circuit with a multiplier circuit to combine a light sensor output with a user adjustable digital word.

FIG. 9 is a schematic diagram of one embodiment of a brightness control circuit with a multiplier circuit to combine a light sensor output with a user adjustable digital word. Some display systems use a DAC 918 for dimming control. A binary input (bn . . . b1) is used to indicate user dimming preference. The DAC 918 generates an analog voltage (Vout) corresponding to the binary input. The analog voltage is the brightness control signal at an output of the brightness control circuit. In one embodiment, a voltage clamp circuit 920 is coupled to the output brightness control circuit to limit the range of the brightness control signal.

The value of the analog voltage also depends on a reference voltage (Vref) of the DAC 918. In one embodiment, the reference voltage is generated using a sensor current signal from a visible light sensor 902 that senses ambient light. For example, the visible light sensor 902 drives a network of resistors (R1, R2, R3) 906, 902, 912 through an isolation diode 904. An output of the visible light sensor 902 is coupled to an anode of the isolation diode 904. The first resistor (R1) 906 is coupled between a supply voltage (VCC) and a cathode of the isolation diode 904. The second resistor (R2) 908 is coupled in series with a semiconductor switch 910 between the cathode of the isolation diode 904 and ground. The third resistor (R3) 912 is coupled between the cathode of the isolation diode 904 and ground. An optional capacitor 914 is coupled in parallel with the third resistor 912 to provide filtering. An optional buffer circuit 916 is coupled between the cathode of the isolation diode 904 and the reference voltage input of the DAC 918.

The brightness control circuit of FIG. 9 can be configured for manual mode operation with the visible light sensor 902 disabled or for auto mode operation with the visible light sensor 902 enabled. An enable signal (AUTO) is provided to a buffer circuit 900 to make the selection between auto and manual modes. An output of the buffer circuit 900 is provided to an input of the visible light sensor 902 and to a gate terminal of the semiconductor switch 910.

When the enable signal is logic high to select auto mode operation, the visible light sensor 902 is active and the semiconductor switch 910 is on to effectively couple the second resistor 908 in parallel with the third resistor 912. In the auto mode, the equation for the brightness control signal (BCS5) at the output of the DAC 918 is:

$$BCS5 = binary\%fullscale \times \left[\left(\frac{[VCC \times (R2 \times R3)] + [ISRC \times R1 \times R2 \times R3]}{(R1 \times R2) + (R1 \times R3) + (R2 \times R3)}\right)\right].$$

When the enable signal is logic low to select manual mode operation, the visible light sensor 902 is disabled and the semiconductor switch 910 is off to effectively remove the second resistor 908 from the circuit. In the manual mode, the equation for the brightness control signal (BCS6) at the output of the DAC 918 is:

$$BCS6 = binary\%fullscale \times VCC \times \frac{R3}{(R1 + R3)}.$$

Figure 10:
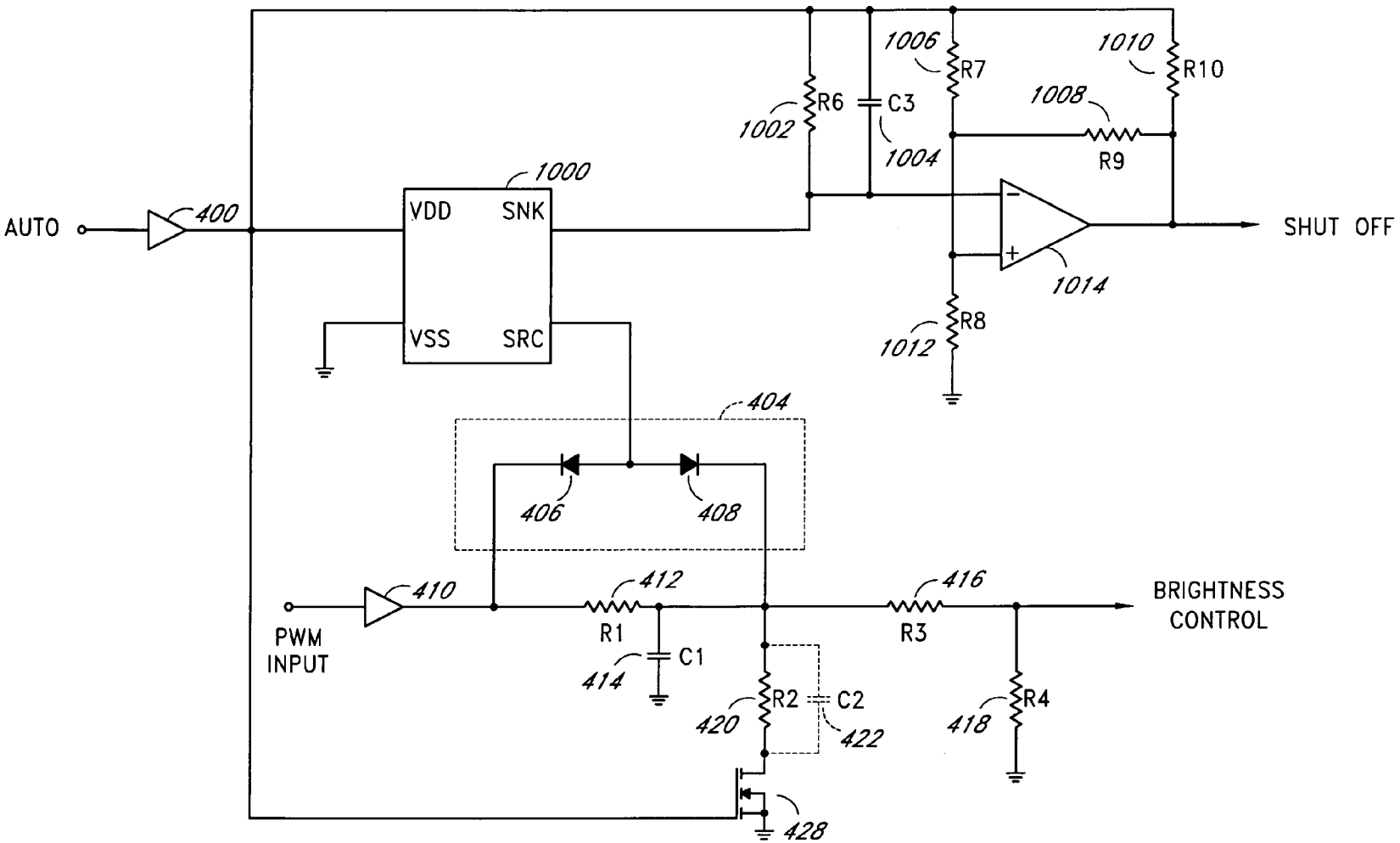
FIG. 10 is a schematic diagram of one embodiment of a brightness control circuit with automatic shut down when ambient light is above a predetermined threshold.

FIG. 10 is a schematic diagram of one embodiment of a brightness control circuit with automatic shut down when ambient light is above a predetermined threshold. When lighting transflective displays, it may be preferred to shut off auxiliary light sources (e.g., backlight or frontlight) when ambient lighting is sufficient to illuminate the display. In addition to generating the brightness control signal (BRIGHTNESS CONTROL), the brightness control circuit of FIG. 10 includes a shut down signal (SHUT OFF) to disable the backlight or the frontlight when the ambient light level is above the predetermined threshold.

The brightness control circuit of FIG. 10 advantageously uses a visible light sensor 1000 with two current source outputs that produce currents that are proportional to the sensed ambient light. The two current source outputs include a sourcing current (SRC) and a sinking current (SNK). The sourcing current is used to generate the brightness control signal. By way of example, the portion of the circuit generating the brightness control signal is substantially similar to the brightness control circuit shown in FIG. 4 and is not further discussed.

The sinking current is used to generate the shut down signal. In one embodiment, a comparator 1014 generates the shut down signal. A resistor (R6) 1002 is coupled between a selective supply voltage and the sinking current output of the visible light sensor 1000 to generate a comparison voltage for an inverting input of the comparator 1014. A low pass filter capacitor (C3) 1004 is coupled in parallel with the resistor 1002 to slow down the reaction time of the sinking current output to avoid triggering on 60 hertz light fluctuations. A resistor (R7) 1006 coupled in series with a resistor (R8) 1012 between the selective supply voltage and ground generates a threshold voltage for a non-inverting input of the comparator 1014. A feedback resistor (R9) coupled between an output of the comparator 1014 and the non-inverting input of the comparator 1014 provides hysteresis for the comparator 1014. A pull-up resistor (R10) is coupled between the selective supply voltage and the output of the comparator 1014. The selective supply voltage may be provided by the output of the buffer circuit 400 which also enables the visible light sensor 1000.

When the ambient level is relatively low, the sinking current is relatively small and the voltage drop across the resistor 1002 conducting the sinking current is correspondingly small. The comparison voltage at the inverting input of the comparator 1014 is greater than the threshold voltage at the non-inverting input of the comparator, and the output of the comparator 1014 is low. When the ambient level is relatively high, the sinking current is relatively large and the voltage drop across the resistor 1002 is also large. The comparison voltage at the inverting input of the comparator 1014 becomes less than the threshold voltage and the comparator 1014 outputs logic high to activate the shut down signal. Other configurations may be used to generate the shut down signal based on the sensed ambient light level.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A visual information display system with ambient light correction comprising:

a visible light sensor configured to output a sensor current signal in proportion to the level of ambient light;

a dimming control input signal determined by a user to indicate a desired brightness level for one or more light sources, wherein the dimming control input signal is represented by a user adjustable pulse-width-modulation logic signal;

a multiplier circuit configured to generate a brightness control signal based on a mathematical product of the sensor current signal and the dimming control input signal, wherein the multiplier circuit comprises:

a pair of current steering diodes configured to multiply the sensor current signal by the user adjustable pulse-width-modulation logic signal to generate the brightness control signal, wherein anodes of the current steering diodes are coupled to an output of the visible light sensor to receive the sensor current signal;

a network of resistors coupled to cathodes of the current steering diodes and configured to scale the brightness control signal; and at least one capacitor coupled to the network of resistors and configured as a low pass filter for the brightness control signal; and a display driver configured to adjust brightness levels of the light sources in response to the brightness control signal.

2. The visual information display system of claim 1, further comprising a dark level bias circuit configured to maintain the brightness control signal above a predetermined level when the ambient light level decreases to approximately zero.

3. The visual information display system of claim 1, further comprising an overdrive clamp circuit configured to limit the brightness control signal to be less than a predetermined level.

4. The visual information display system of claim 1, further comprising an automatic shutdown circuit configured to turn off auxiliary light sources in a transflective display system when the ambient light is greater than a predefined level.

5. The visual information display system of claim 1, wherein the visible light sensor comprises an array of PIN diodes on a single substrate that produces a current which is amplified to be the sensor current signal.

6. The visual information display system of claim 1, wherein the visible light sensor has an adjustable response time using a capacitor.

7. A visual information display system with ambient light correction comprising:

a visible light sensor configured to output a sensor current signal in proportion to the level of ambient light;

a dimming control input signal determined by a user to indicate a desired brightness level for one or more light sources;

a multiplier circuit configured to generate a brightness control signal based on a mathematical product of the sensor current signal and the dimming control input signal, wherein the dimming control input signal is provided as a digital word and the multiplier circuit further comprises:

a digital-to-analog converter configured to receive the digital word and to output an analog signal representative of the brightness control signal based on a multiplication of the digital word and a reference voltage;

an isolation diode with an anode coupled to an output of the visible light sensor to receive the sensor current signal and a cathode coupled to a network of resistors, wherein the network of resistors conducts the sensor current signal to generate the reference voltage for the digital-to-analog converter; and an optional output capacitor configured as a low pass filter for the reference voltage; and a display driver configured to adjust brightness levels of the light sources in response to the brightness control signal.

8. The visual information display system of claim 1, wherein the display driver is an inverter and the light sources are fluorescent lamps for backlighting a liquid crystal display.

9. The visual information display system of claim 1, wherein the light sources are light emitting diodes for backlighting a liquid crystal display.

10. A method to adjust display brightness over ambient light variations, the method comprising the steps of:

sensing ambient light with a visible light detector, wherein the visible light detector outputs a sensor current signal that varies linearly with the ambient light level;

multiplying the sensor current signal with a user-adjustable dimming control input signal to generate a brightness control signal, wherein the user-adjustable dimming control input signal is a pulse-width-modulation logic signal and the multiplying step further comprises the steps of:

steering the sensor current signal toward a network of resistors when the pulse-width-modulation logic signal has a first logic level; and steering the sensor current signal away from the network of resistors when the pulse-width-modulation logic signal has a second logic level, wherein the network of resistors generate the brightness control signal based on a multiplication of the sensor current signal and a duty cycle of the pulse-width- modulation logic signal; and providing the brightness control signal to a display driver to thereby adjust brightness levels of one or more light sources.

11. The method of claim 10, wherein the visible light detector has an adjustable response time to allow the sensor current signal to remain substantially unchanged during transient variations of less than a predefined duration in the ambient light.

12. The method of claim 10, further comprising the step of shutting off the display driver when the ambient light level is above a predetermined threshold.

13. The method of claim 10, further comprising the step of clamping the brightness control signal to be less than a predetermined level to comply with an input range of the display driver.

14. The method of claim 10, wherein the visible light detector comprises a full spectrum PIN diode and an infrared sensitive PIN diode, an initial current in proportion to the ambient light level is generated from taking a difference between respective outputs of the full spectrum PIN diode and the infrared PIN diode, and the initial current is amplified by a series of current mirrors to be the sensor current signal.

15. A method to adjust display brightness over ambient light variations, the method comprising the steps of:

sensing ambient light with a visible light detector, wherein the visible light detector outputs a sensor current signal that varies linearly with the ambient light level;

multiplying the sensor current signal with a user-adjustable dimming control input signal to generate a brightness control signal, wherein the user-adjustable dimming control input signal is a digital word and the multiplying step further comprises the steps of:

providing the digital word to a digital-to-analog converter for conversion to an analog output voltage that is representative of the brightness control signal; and generating a reference voltage for the digital-to-analog converter by driving a resistor network with the sensor current signal from an output of the visible light detector such that the brightness control signal is based on a multiplication of the sensor current signal and a value of the digital word; and providing the brightness control signal to a display driver to thereby adjust brightness levels of one or more light sources.

16. A visual information display system with ambient light correction comprising:

means for monitoring ambient light and generating a sensor current signal with an amplitude proportional to the ambient light level;

means for multiplying the sensor current signal and a dimming control input signal with a first current steering diode and a second current steering diode to generate a brightness control signal, wherein the dimming control input signal is a pulse-width-modulation logic signal, the first current steering diode conducts the sensor current signal when the pulse-width-modulation logic signal has a first logic level, and the second current steering diode conducts the sensor current signal when the pulse-width-modulation logic signal has a second logic level such that the brightness control signal is based on a multiplication of the sensor current signal and a duty cycle of the pulse-width-modulation logic signal; and means for adjusting display brightness of one or more light sources with the brightness control signal.

17. The visual information display system of claim 16, wherein a user sets the dimming control input signal based on a perceived brightness level and the brightness control signal varies with the ambient light to maintain the perceived brightness level.

18. The visual information display system of claim 16, further comprising means for automatically shutting down at least one of the light sources when the ambient light level is greater than a predefined level.

19. A brightness control circuit comprising:

a visible light sensor configured to generate a sensor current signal indicative of ambient light;

a buffer circuit configured to receive a pulse-width-modulation logic signal indicative of a user desired brightness level;

a pair of current steering diodes comprising a first diode and a second diode with commonly connected anodes that are coupled to an output of the visible light sensor to receive the sensor current signal, wherein the first diode conducts the sensor current signal when the pulse-width-modulation logic signal has a first logic level and the second diode conducts the sensor current signal when the pulse-width-modulation logic signal has a second logic level;

a network of resistors coupled to an output of the buffer circuit and cathodes of the first diode and the second diode, wherein the network of resistors generates a brightness control signal at an output node based on a multiplication of the sensor current signal and a duty cycle of the pulse-width-modulation logic signal; and a display driver configured to receive the brightness control signal and to deliver power to one or more light sources to achieve a brightness level in accordance with the brightness control signal.

20. The brightness control circuit of claim 19, wherein the visible light sensor comprises a full spectrum PIN diode and an infrared sensitive PIN diode, and the sensor current signal is proportional to a difference between an output of the full spectrum PIN diode and an output of the infrared sensitive PIN diode.

21. The brightness control circuit of claim 19, wherein the visible light sensor is configured to generate an additional sensor current signal indicative of the ambient light and the additional sensor current signal is used to generate a shut down signal that disables at least one of the light sources when the ambient light is above a predetermined threshold.

* * * * *

UNITED STATES PATENT AND TRADEMARK OFFICE

CERTIFICATE OF CORRECTION

PATENT NO. : 7,468,722 B2
APPLICATION NO. : 11/023295
DATED : December 23, 2008
INVENTOR(S) : Ferguson It is certified that error appears in the above-identified patent and that said Letters Patent is hereby corrected as shown below:

On Page 4, Col. 2 at line 40 under Other Publications (Item 56), change "Unvalidity" to --Invalidity--.

On Page 5, Col. 1 at line 10 under Other Publications (Item 56), after "Motion" insert --and Motion--.

On Page 5, Col. 2 at line 19 under Other Publications (Item 56), change "invertor" to --inverter--.

In column 7 at lines 17-18, change " $\left[\left(\frac{VCC \times R2 \times R4}{[(R1+R2)\times(R3+R3)]+(R1\times R2)}\right)\right.$ "

to -- $\left[\left(\frac{VCC \times R2 \times R4}{[(R1+R2)\times(R3+R4)]-(R1\times R2)}\right)\right.$ --.

In column 7, lines 19-20, change " $\left(\frac{ISRC \times R1 \times R2 \times R4}{[(R1+R2)\times(R3+R4)+(R1+R2)}\right)\Bigg]$ "

to -- $\left(\frac{ISRC \times R1 \times R2 \times R4}{[(R1+R2)\times(R3+R4)+(R1+R2)}\right)\Bigg]$ --.

In column 12, line 62, in Claim 4, change "transfiective" to --transflective--.

In column 13, line 58, in Claim 10, change "pluse-width- modulation" to --pulse-width-modulation--.

Signed and Sealed this

Thirtieth Day of June, 2009

John Doll

JOHN DOLL
*Acting Director of the United States Patent and Trademark Office*